US005132984A

United States Patent [19]

Simpson

[11] Patent Number: 5,132,984

[45] Date of Patent: Jul. 21, 1992

[54] SEGMENTED ELECTRIC FURNACE

[75] Inventor: Matthew Simpson, Marlborough, Mass.

[73] Assignee: Norton Company, Worcester, Mass.

[21] Appl. No.: 607,954

[22] Filed: Nov. 1, 1990

[51] Int. Cl.[5] ..... H05B 7/00

[52] U.S. Cl. ..... 373/18; 373/24; 373/65; 373/75; 373/19

[58] Field of Search ..... 373/18, 19, 20, 23, 373/24, 25, 62, 64, 72, 83, 84, 88, 75, 65

[56] References Cited

U.S. PATENT DOCUMENTS 3,775,091 11/1973 Clites et al. ..... 373/155
4,336,411 6/1982 Hanas et al. ..... 373/72
4,466,824 8/1984 Gauvin et al. ..... 75373/11
4,644,557 2/1987 Ebeling et al. ..... 373/22
4,660,212 4/1987 Boen et al. ..... 373/156
4,686,687 8/1987 Mure et al. ..... 373/22
4,900,249 2/1990 McCollum et al. ..... 373/162
4,912,296 3/1990 Schlienger ..... 373/18
4,940,486 7/1990 Sommerville et al. ..... 373/9

*Primary Examiner*—Bruce A. Reynolds
*Assistant Examiner*—Tu Hoang
*Attorney, Agent, or Firm*—Volker Ulbrich

[57] ABSTRACT

An electric furnace comprising a container having electrically isolated wall segments useful for melting materials, particlularly ceramics, is disclosed.

The electric fornace's side walls are constructed from electrically isolated segments, which cause electric current from a plasma torch to be concentrated on the material in the furnace to be melted rather than diverted to the walls of the furnace.

20 Claims, 6 Drawing Sheets

SEGMENTED ELECTRIC FURNACE

TECHNICAL FIELD

The present invention is directed to an electric furnace constructed of electrically isolated segments for use in melting materials, particularly ceramics, having resistivities of greater than $10^{-1}$ ohm-cm in the solid state at temperatures well below their melting points and substantially lower resistivities in the liquid state. It also is concerned wit means to tap from such furnaces.

BACKGROUND

Electric furnaces have been used since the nineteenth century to melt refractory or reactive materials. They are now the most common means for melting practically all ceramics and all high-melting point materials that react readily with air. The type of electric furnace most favored for melting large quantities of material is the electric carbon arc furnace with carbon electrodes as shown in FIGS. 1*a* and 1*b*. The carbon arc furnace device 10 is simple to construct and operate, but suffers from the disadvantage that its carbon electrodes are in close proximity to the product 13. This proximity of the electrodes to slag spray near the surface of the melting material 13 and their high temperature oxidation typically results in excessive electrode erosion, thus increasing the cost of the operation and sometimes contaminating the product. For example, the cost of electrode erosion during manufacture of zirconia from zircon may be more than 15% of the total manufacturing cost.

The conventional plasma arc furnace 15, shown in FIG. 1*c*, is an improvement over the carbon arc furnace in some respects. An arc is struck between a non-consumable electrode 16 inside a plasma torch 17 and the charge as before, but a protective flow of gas 18 past the electrode in the torch avoids the erosion problems of the carbon arc furnace. The current in the furnace usually runs through the charge to a counter-electrode 19 at the bottom. In other respects it is similar to the carbon arc furnace.

Both the carbon arc furnace and the conventional plasma arc furnace do not have a favorable geometry for heat retention in the melt. As can be seen from FIGS. 1 a–c the molten region is wide and flat to prevent the passage of current directly across the surface to a sidewall. This geometry leads to considerable heat loss; for materials with melting points over about 2000K, radiation is the main source of heat loss, so the upper surface will lose especially large amounts of heat to result in an unfavorable ratio between the initial charge of material and the amount of melt obtained from it.

A second disadvantage of the conventional furnaces is the large amount of solid material relative to the amount of molten material in them. The walls of these furnaces cannot be brought close to the arc heat source, since then electric arcs might strike directly to the walls.

A third problem associated with the carbon arc furnace and the conventional plasma arc furnace relates to discharge of the molten product. For casting processes not involving very refractory or reactive materials, it is best to discharge the product on a continuous basis. This limits the size, and hence the cost, of the molds and handling equipment and eases the task of making material of consistent quality. Such continuous casting has not been possible (except on operations of uncommonly large scale) with carbon arc or conventional plasma furnaces melting refractory materials because of the tendency of the product to freeze in the spout from which the pouring is done.

SUMMARY OF THE INVENTION

The present invention relates to an electric furnace design which affords improved control over the geometry of the melt of the charge. It is useful for the efficient melting of materials, particularly ceramics, in which furnace the ratio of melted to unmelted material can be relatively large. The invention also permits the effective tapping of the melted refractory from the furnace.

According to the present invention, the electric furnace comprises a container having sidewalls and a base. The sidewalls are constructed from electrically conductive segments which are isolated from each other by means of non-conductive segments. A plasma torch supplies the electric current and heat to the furnace. Appropriate dimensional choices of the segments permit a control of the geometry of the melt mass by determining the current path within the material charge. Current flows from the electrode of the torch through the material in the furnace which is being melted to a member of the furnace, such as a base or sidewall section, having the opposite polarity of the torch electrode. Unlike the prior art furnaces, the molten materials can be relatively close to the walls without risking electrical problems. Thus, the majority of the material in the furnace can be molten.

The furnace and method of the present invention are useful for melting materials having a substantially higher resistivity range in the solid state than in the liquid state. The resistivity in the solid state must be greater than about $10^{-1}$ ohm cm at room temperature and substantially lower in the liquid state, between about $10^{-3}$ ohm cm and about $10^{2}$ ohm cm. This includes a large variety of ceramic materials, but excludes most metals.

The invention will now be described with reference to the drawings.

BRIEF DESCRIPTION OF THE DRAWINGS

FIG. 4(*b*) is a sectional view of the point of attachment of the angle iron support to the electrically isolated segment plate.

FIG. 4(*c*) is a side view of a steel plate of the support assembly of FIG. 4(*a*).

DESCRIPTION OF THE PREFERRED EMBODIMENTS

Figure 2:
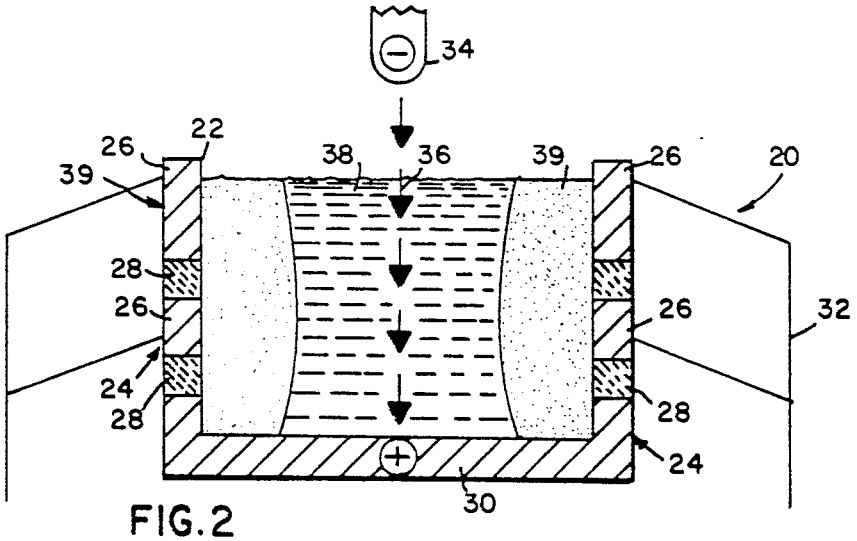
FIG. 2 is a sectional view of the furnace of the present invention.
Figure 3:
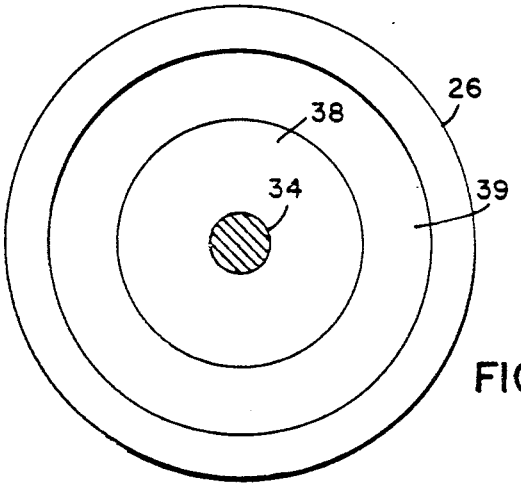
FIG. 3 is a top view of the furnace of FIG. 2.
Figure 4A:
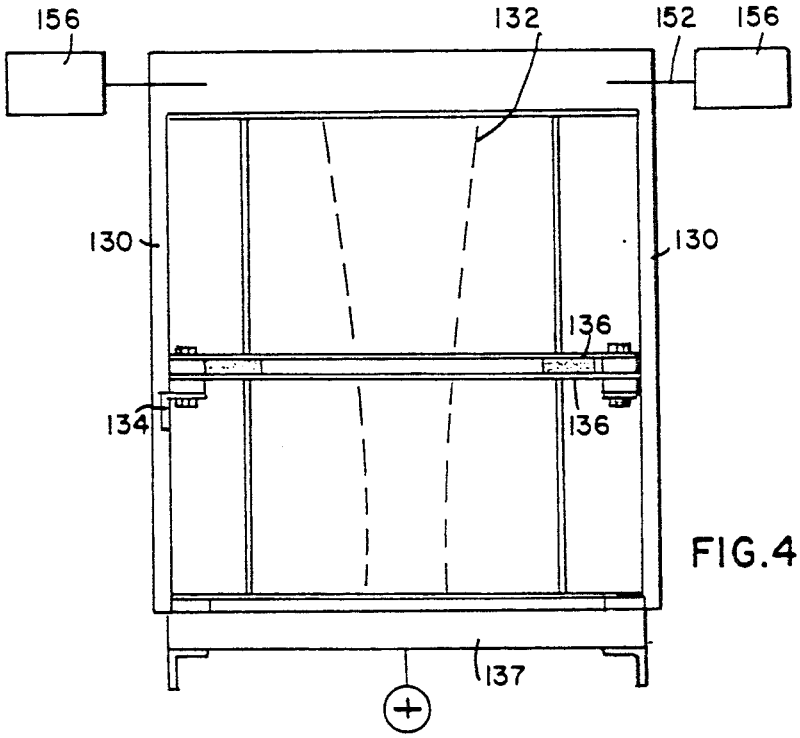
FIG. 4(*a*) is a front view of the furnace supporting assembly .
Figure 4B:
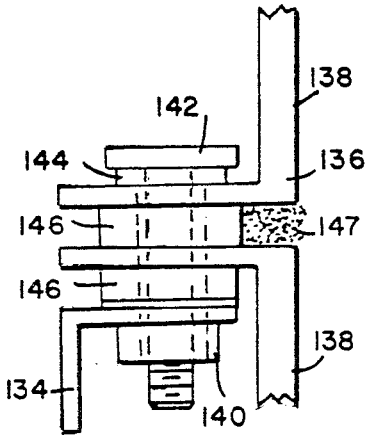

Referring to the drawings, the electric furnace of the present invention is shown generally in FIGS. 2 and 3. As shown in FIG. 2, the electric furnace 20 comprises a container 22 having sidewalls 24 which are constructed of electrically conducting isolated segments 26 separated from each other by electrically non-conductive spacer segments 28. The number of segments 26 and 28 will depend upon the size of the furnace and upon the materials to be melted in the furnace. For melting purposes, it is desirable to have the length, width, and height of the furnace approximately equal. The segment arrangement is selected to ensure that the voltage between adjacent segments is small enough to prevent arcs from occurring between segments, and thereby producing a current path that does not run through the melt. It is best to keep this voltage at less than about 50 V. Thus, if materials of high resistivity are to be melted, the segments will be shorter than if materials of lower resistivity are melted. Similarly, larger furnaces will have longer segments than smaller ones. The segments are preferably arranged so that equipotential surfaces in the melt lie in approximately the same plane as insulating segments. This helps ensure that the voltage on the segment remains approximately constant independent of the charge in the crucible. The sidewalls are connected to a base 30, which is also separated from the sidewall segments 26 by a non-conductive spacer segment 28. While shown as a cylindrical container the furnace may be of other suitable shape. It is presently preferred to employ a furnace having generally cylindrical internal dimension and substantially rectangular outer dimensions. The electric furnace also contains a plasma torch 34, which supplies the electric current and heat to the furnace to melt the material within the furnace. As shown, the plasma torch has a negative electrode, while the base 30 is the anode. The plasma torch could, however, be the anode with the base 30 being the cathode. To add support to the sidewalls, a conventional support structure may be used. The particular support structure that is used will depend upon the exterior shape of the furnace. For the purposes of illustration, FIGS. 4 (a–c)–5 show a typical support structure for a furnace of the present invention having substantially cylindrical internal dimension and substantially rectangular exterior dimensions. As shown in FIGS. 4 (a–c)–5, the support structure comprises steel plates 130 which extend around two sides of the furnace. The steel plates support angle iron brackets 134 which are attached to plates 136 of the isolated conductive metal segments 138. As best shown in FIG. 4(*b*), the angle iron supports 134 are attached by means of a nut 140 and bolt 142. An insulating spacer 144 between the bolt and plate 136 is used along with plastic spacers, such as phenolic spacers 146. An insulating powder 147 such as the material to be melted may be used to keep heat from spacers 146. As shown, there are multiple points of attachment for the angle irons 134 to the plates 136 around the perimeter of the furnace. FIG. 5 shows 8 points of attachment of bolts 142. The angle iron supports are preferably attached to the steel plates by nuts and bolts (not shown).

Figure 4C:
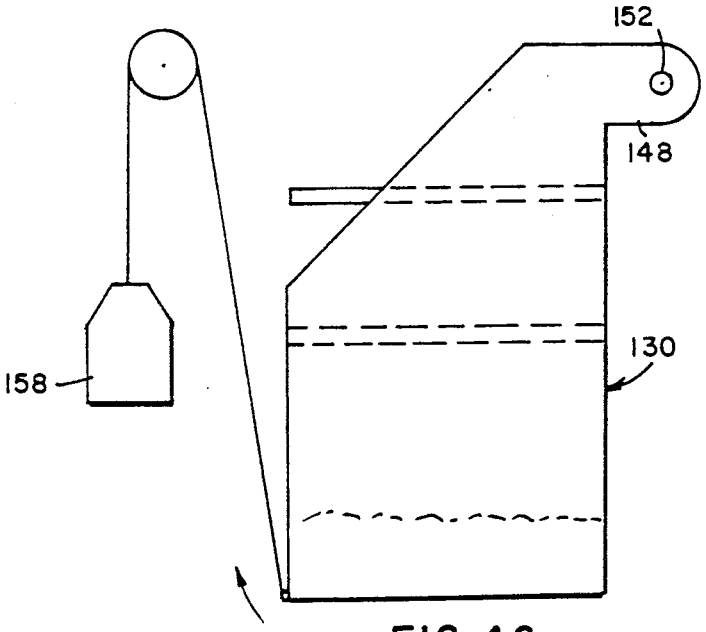
Figure 5:
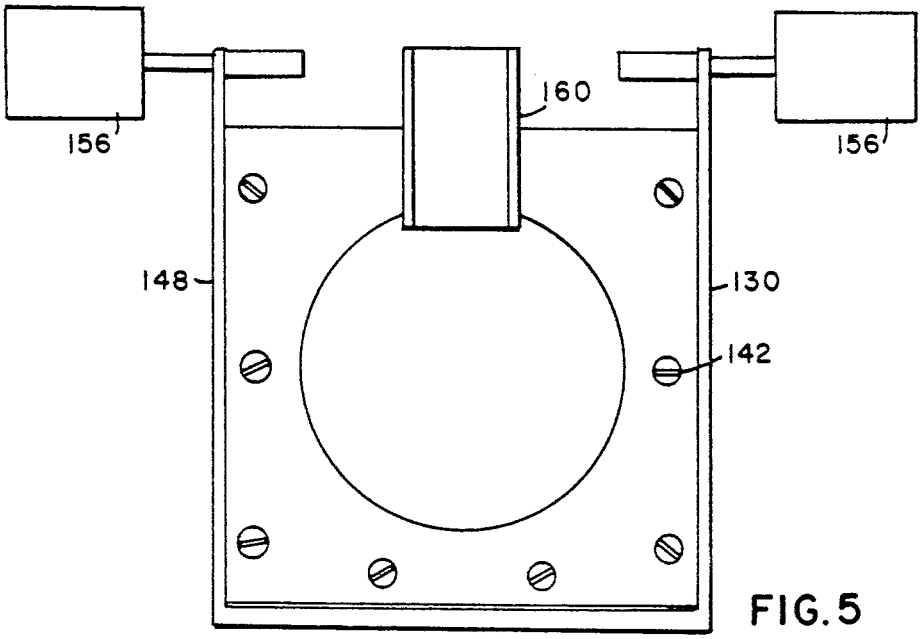
FIG. 5 is a top view of FIG. 4(*a*).

FIG. 4(*c*) shows a typical steel plate 130 which is placed on the two sides of the furnace having protrusions 148 to which axles 152 are attached. As best shown in FIG. 4*c*, the protrusions 148 extend beyond the front face of the furnace. Each axle 152 is attached by means of suitable gears to furnace tilt motors 156. The furnace tilt motors rest on the furnace frame and support the furnace through axles 152. While not necessary, it is desirable to attach counterweights 158 to each of the side steel plates 130 to balance the furnace assembly during a tilting operation.

In operation, the furnace tilt motors function together with associated gears to rotate the back end of the furnace upwards, thereby tilting the pour spout 160 (only shown in FIG. 5) downward. Such a tilting operation is one way to remove product from the furnace.

Conventional plasma torches of the types used for melting metals may be used. The gas used in the torch may be anything that will allow smooth operation of the torch while not contaminating the product being melted. As is the case for melting metals, argon is suitable, although other suitable gases include hydrogen, helium, nitrogen, air, and carbon oxides, either separately or in mixtures, depending on the nature of the specific materials to be melted. Again, as for metal melting, the temperature of the plasma is preferably as high as possible, consistent with reliable operation of the torch. This temperature will vary depending on the gas selected. For argon, the temperature may be about 15,000°–20,000K, whereas for hydrogen it might only be about 8,000K.

The electrically isolated segments 26 may be constructed of any suitable material resistant to melting at temperatures at which the furnace operates when cooled appropriately. While copper is presently preferred, brass, bronze, steel, or aluminum may also be used. Although not shown, the segments 26 may be cooled by any suitable means, including passing a cooling liquid such as water through the segment walls. The spaces between the electrically isolated segments 26 are maintained using non-conductive spacers 28. The mounting frame 32 tends to push the segments together. If the spacers are far from the inner wall of the furnace, then they can be made from plastic of which fluoropolymers, phenolic- or silicone-matrix composites are suitable. The exact mechanical arrangement of the furnace will determine which is most suitable.

Generally, the spacers 28 do not occupy all of the gap between the segments. The spaces (not shown) between the spacers 28 are advantageously filled with powder. It is convenient to use powder of the same composition as the material to be melted in the furnace. It is preferable to pack this powder in the spaces before the charge is placed in the furnace.

The base 30 is preferably constructed of copper having its top surface coated with silver. When the base 30 is the cathode, the protective silver coating may be dispensed with, since the base is not as subject to attack by the material being melted as when the base is the anode. Other suitable materials for use in making the base include steel, bronze, and aluminum. The base need not be cooled to the same extent as the sides if it is intended that the base melt partially during operation. This simplifies the construction of the base, but may lead to contamination of the product with the base metal. This problem is particularly acute if the positive side of the power supply is connected to the base. An alternative way to protect the base from erosion is to use a layer of crushed carbon on top of the metal base. The melted liquid then comes into contact only with the carbon and, as a result, does not attack the base. The carbon gradually disappears into the melt and may be replaced by feeding through the base into the layer of crushed carbon a gas, such as methane, which decomposes to produce carbon when heated. The gas decomposes in the heat of the furnace to leave carbon behind, thus replacing the carbon lost to the melt.

The electric furnace is particularly useful in melting materials having a resistivity in their solid state of greater than about $10^3$ ohm cm at room temperature and a resistivity in the liquid state of greater than about $10^{-3}$ ohm cm and less than about $10^3$ ohm cm.

The restriction on the minimum resistivity of the solid is necessary to ensure that the current flows mostly through the liquid. The maximum value of the resistivity of the liquid is specified because at higher values it would be too difficult to force current through the liquid. The minimum value is defined because the volume of liquid would be too small. Materials that come within this description include substantially all ceramic oxides as well as most ceramic halides and some sulfides and borides. Specific materials include aluminum oxide, zirconium oxide, titanium oxide, yttrium or rare earth oxides, magnesium oxide, calcium oxide, aluminum sulfide, rare earth fluorides or chlorides optionally mixed with rare earth oxides or other halides, aluminum nitride or silicon nitride mixed with sufficient oxide to produce a melt, boron, boron-based solid solutions, and the like.

Figure 1A:
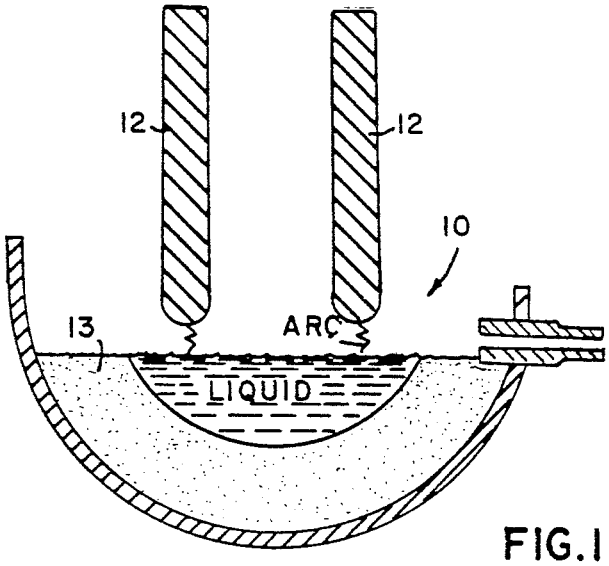
FIG. 1A (PRIOR ART)
FIG. 1*a* is a sectional view of a prior art furnace.
Figure 1B:
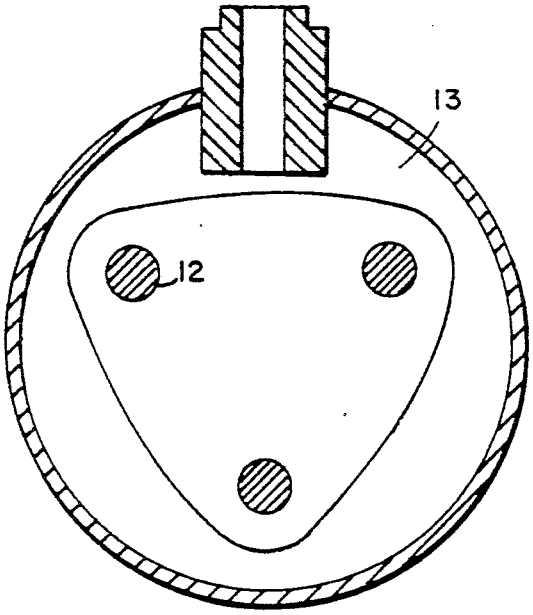
FIG. 1B (PRIOR ART)
FIG. 1*b* is a top view of FIG. 1*a*.
Figure 1C:
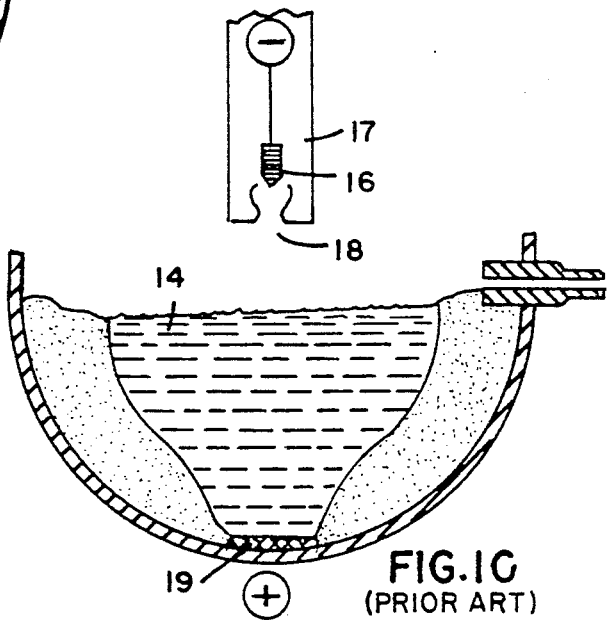
FIG. 1C (PRIOR ART)
FIG. 1*c* is a sectional view of another prior art furnace.

In operation, the current from the plasma torch flows in the direction of arrows 36 to the base 30 through the material being melted, bypassing the sidewall 24 due in part to the electrically isolated segments.26 which prevent the flow of electric current. The segments in effect permit the melted material resistance to establish a voltage gradient more linearly directed between the plasma torch and the base 30 than if the furnace walls were all a uniform potential, as with prior arrangements. This results in a relatively large portion of the material being melted into a liquid state 38 leaving only a relatively small portion unmelted in the solid state 39. This is in contrast to the prior art furnaces as shown in FIGS. 1 *a–c* wherein current flows in the direction of the plasma gas 18 and then down the sidewalls and to the counter-electrode 19, by-passing most of the material being processed in the furnace. During melting, the material is heated to at most a few hundred degrees C above its melting point, because the presence of unmelted material on the walls of the furnace near the insulating space is essential for the operation of the device. The time over which melting occurs is dependent only on the power delivered to the furnace, but it is advantageous not to melt the charge in periods less than about a minute because of the risk of explosion from any residual water present in the feed material.

After the material is melted, it is removed from the furnace either by tipping the furnace or punching a hole in or near the bottom of the furnace. The unmelted material may be either discarded or used again if another batch of the same material is being processed.

Figure 6:
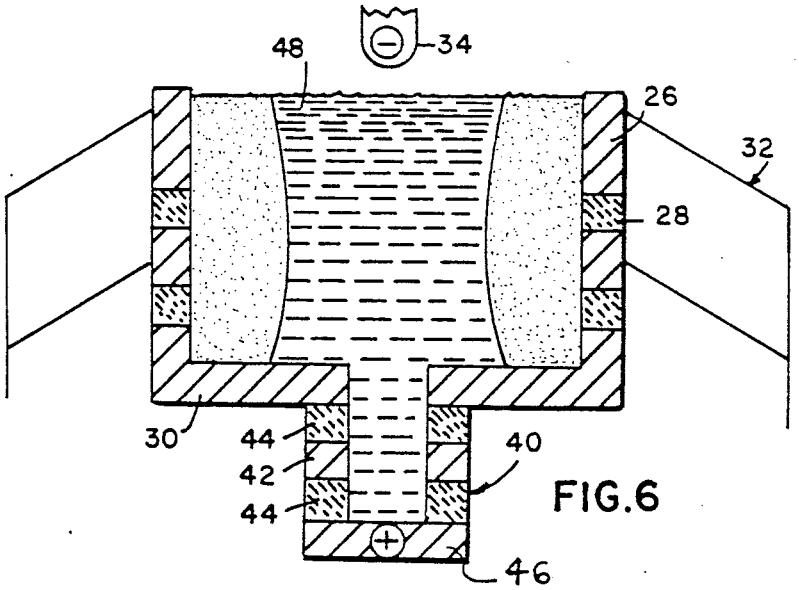
FIG. 6 is a sectional view of another embodiment of the furnace of FIGS. 2 and 3.

FIG. 6 shows another embodiment of the present invention, the same in all respects as the embodiment of FIGS. 2 and 3 with the exception of pour spout 40. Accordingly, like parts have the same reference numbers. As shown, the pour spout 40 comprises an electrically isolated segment 42 and non-conductive spacer segments 44 and a plug electrode 46. Segments 42 and 44 may be constructed of the same materials as the materials used to form members 26 and 28. The plug electrode is preferably attached to an arm (not shown) which allows it to be swung out of the way when tapping is to occur. The plug is preferably constructed of graphite, although watercooled metals such as copper, silver, or steel would also be suitable. Provided the furnace atmosphere is substantially free of oxygen, uncooled metals such as tungsten or molybdenum may also be used. Plug 46 takes the place of the base 30 in the FIGS. 2 and 3 embodiments as the electrode and may be either the cathode (not shown) or the anode (as shown) depending upon the polarity of the plasma torch. As shown, the current flows from the plasma torch to the plug creating a pool of liquid 48 which can flow out of the spout 40 when the plug 46 is removed. Liquid flow can be stopped by reinserting the plug 46. This embodiment provides an easy and an efficient manner in which to remove the liquid product from the furnace.

Figure 7:
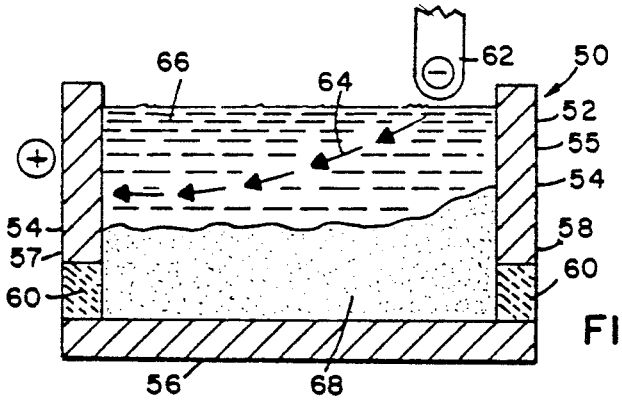
FIG. 7 is a sectional view of another embodiment of a furnace according to this invention.
Figure 8:
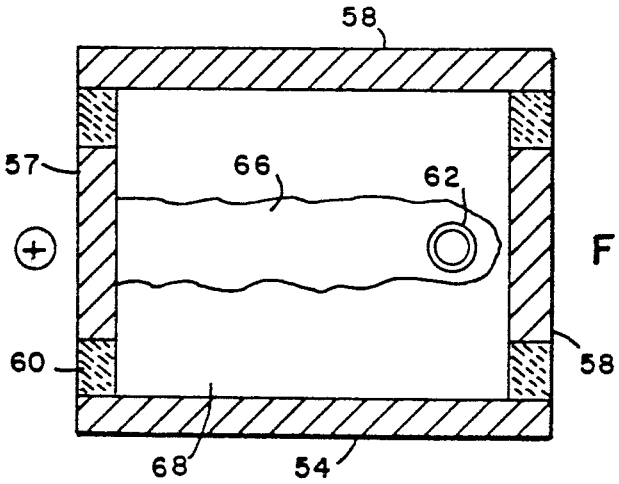
FIG. 8 is a top view of the furnace of FIG. 7.

Still another embodiment of the present invention is shown in FIGS. 7 and 8. The electric furnace 50 comprises a rectangular container 52 having sidewalls 54 and a base 56. The sidewalls comprise electrically isolated segments 58 with non-conductive spacer segments 60 disposed between each of the sidewalls 54 and base 56. Although not shown, sidewalls 54 may be cooled by passing a liquid such as water therethrough. Segments 58 and 60 may be constructed from the same materials as segments 26 and 28 of the embodiments of FIGS. 2 and 3. The size of the segments is determined by the capacity needed for the furnace and by the requirement that the voltage between the segments not be too high. Sometimes it may be desirable to subdivide the segments 26 and 28 into smaller isolated segments in order to reduce the voltage between segments. Base 56 is also constructed of the same materials as base 30 of the embodiment of FIGS. 2 and 3.

A plasma torch 62 is located near one edge of the sidewall 54, which is designated the front face 55. Current from the torch flows into the material to be processed near the front face 55 and across to the rear face 57 sidewall in the direction of arrows 64 melting the material in region 66 while leaving the material in region 68 in an unmelted or solidified state. As shown in this embodiment, the torch electrode is negative while the back face 57 is the anode, although the polarity can be reversed. While not shown, a spout may be installed in the front face to allow for drainage of the melted material.

The embodiments described herein are examples of electric furnaces of the present invention although other variations to these embodiments may be made within the spirit and scope of the invention.

EXAMPLE 1

Figure 9:
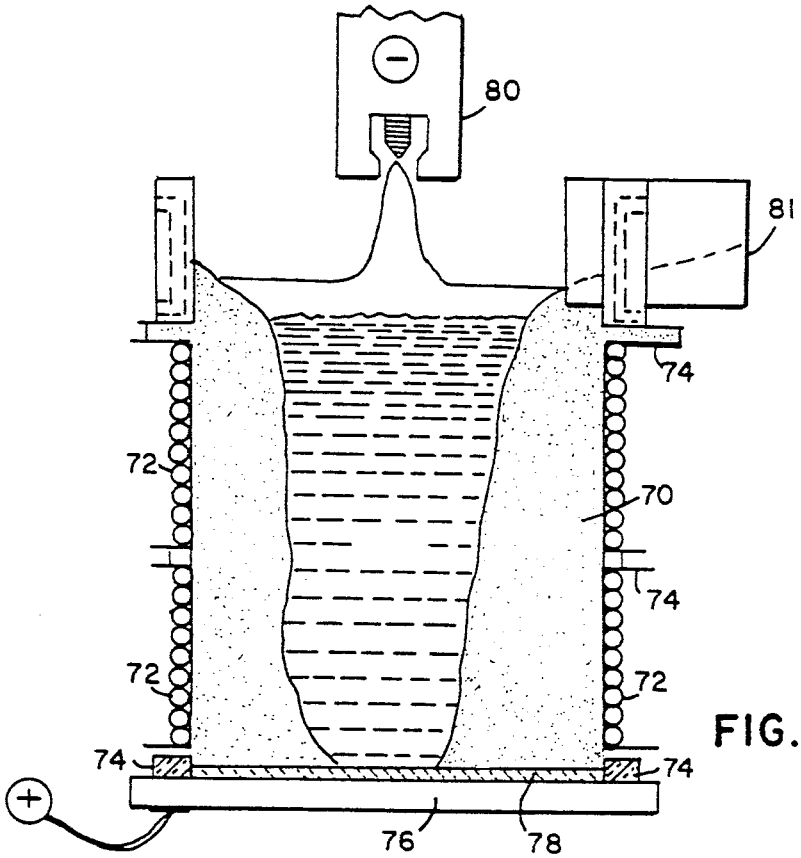
FIG. 9 is a sectional view of another embodiment of the furnace according to this invention.

The furnace 70 shown in FIG. 9 was constructed. Its internal diameter was 25 cm, the height of each water cooled copper segment 72 was 10 cm and the gap between segments was 0.6 cm, which was set using boron nitride and phenolic plastic spacers 74. The water-cooled base 76 had a layer of crushed carbon 78 about 2 cm thick on its upper surface.

The plasma torch 80, a conventional 2000A device using a tungsten cathode (model TA-2000 from Plasma Materials Inc.), was connected to a 300 V open circuit, 1800A d.c. power supply. Argon gas was fed at a rate of about 0.6 standard liters per minute through the torch.

An arc was struck to the crushed graphite layer and $ZrO_2$—3 wt % CaO feed material was added at a rate sufficient to fill the furnace in about 30 minutes. The current was maintained at about 800A, while the voltage was around 150 V. After the furnace was filled, the power was left on for about 10 minutes to melt out toward the walls, thereby forming a liquid melt 82. Thereafter, the furnace was tapped through a graphite pour spout 81. A visual inspection of the furnace after tapping indicated that melting had proceeded to within about 5 cm of the walls over almost the entire length of the furnace.

EXAMPLE 2

This example shows the use of the segmented furnace in a continuous casting application. The particular advantage of the segmented construction is that the arc does not strike to the pouring lip and thereby damage it.

Figure 10:
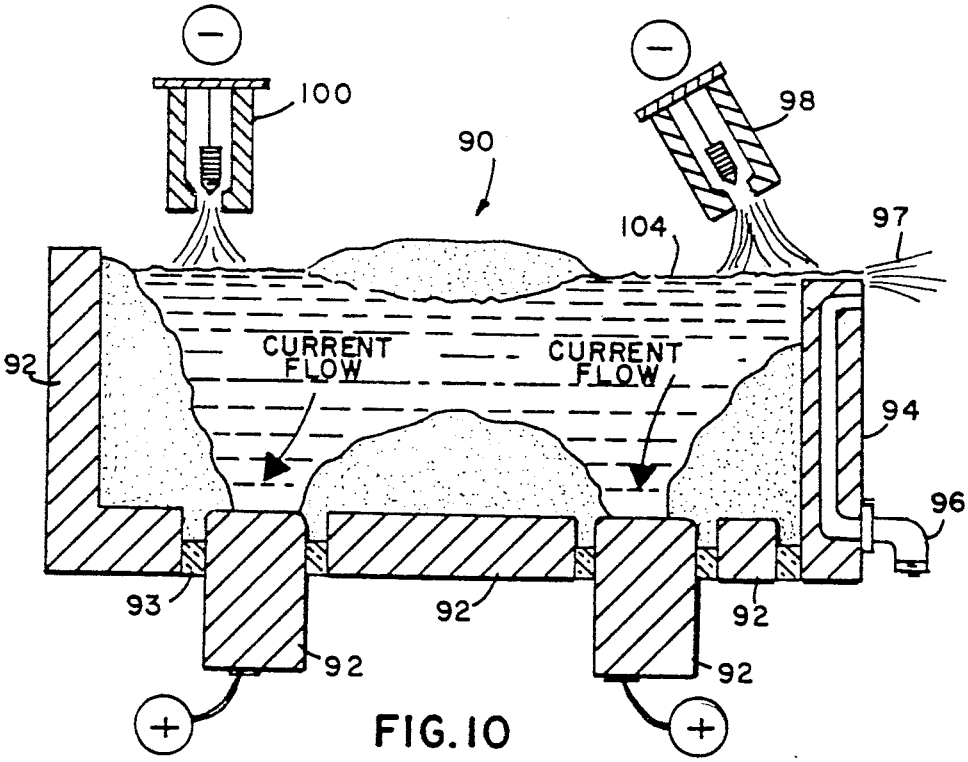
FIG. 10 is a sectional view of still another embodiment of the furnace according to this invention.
Figure 11:
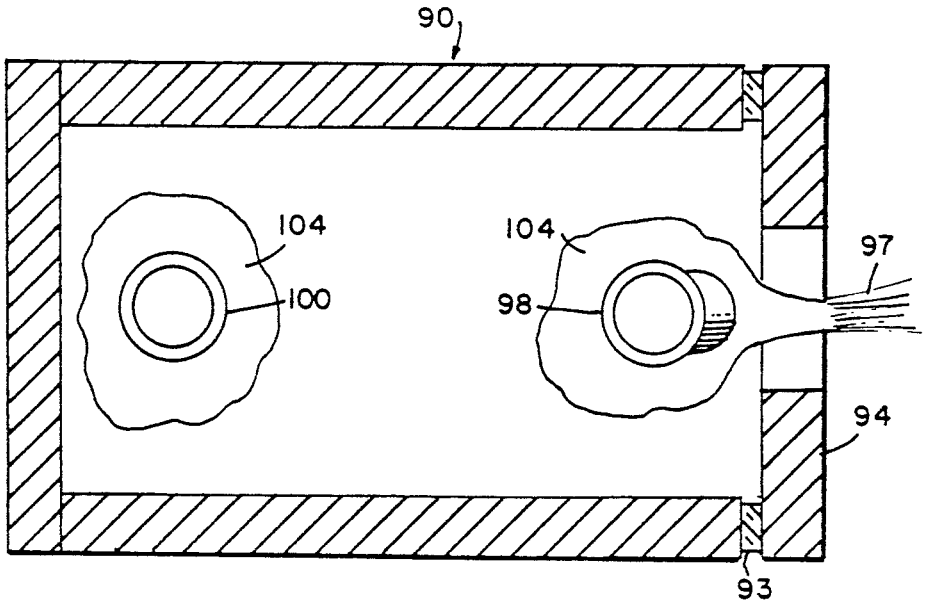
FIG. 11 is a top view of FIG. 10.

The atomizing furnace 90 shown in FIGS. 10 and 11 was constructed. The furnace 90 was constructed from water cooled copper segments 92 with gaps therebetween set with spacers made from glass filled Teflon 93. The isolated watercooled front panel 94 was made of copper. Through the front panel 94 pressurized nitrogen gas was fed through a gas jet pipe 96 for use in atomizing liquid 97 formed by use of plasma torch 98.

At the start of the test run, the furnace was empty and arcs were struck to the electrodes marked + in the drawing. Feed material ($Al_2O_3$—40 wt % $ZrO_2$) was added until the level of molten material approached the lip of the furnace. The current through each torch 98 and 100 was around 150A and the voltage about 100V. The gas flowing through the torches was argon at about 0.3 liters per minute. Nitrogen gas flow at about 0.005 $m^3/s$ and 0.6 MPa pressure was then forced through a slit about 0.7 mm wide and 3 cm long, as shown in the figure.

Then feed material ($Al_2O_3$—40 wt % $ZrO_2$) was added at a rate of about 2 kg/hour to the pool under torch 100. This melted and liquid product dribbled over the lip and was atomized at point 97 by the gas jet 96 to form pool 104. This was continued for about half an hour. At intervals of about 5 minutes, torch 98 was swung out to melt accretions of solid product that formed on the lip. At no point did arcs strike to the lip during the half hour period—such arcs would have damaged the lip.

EXAMPLE 3

This example shows how a furnace melting a refractory material with the appropriate resistivity may be tapped from the bottom without using aggressive mechanical methods but rather with a segmented exit spout which can be used to keep a small hole in the bottom of a furnace. In ordinary practice, holes are opened when needed using thermal lances or shotguns.

Figure 12:
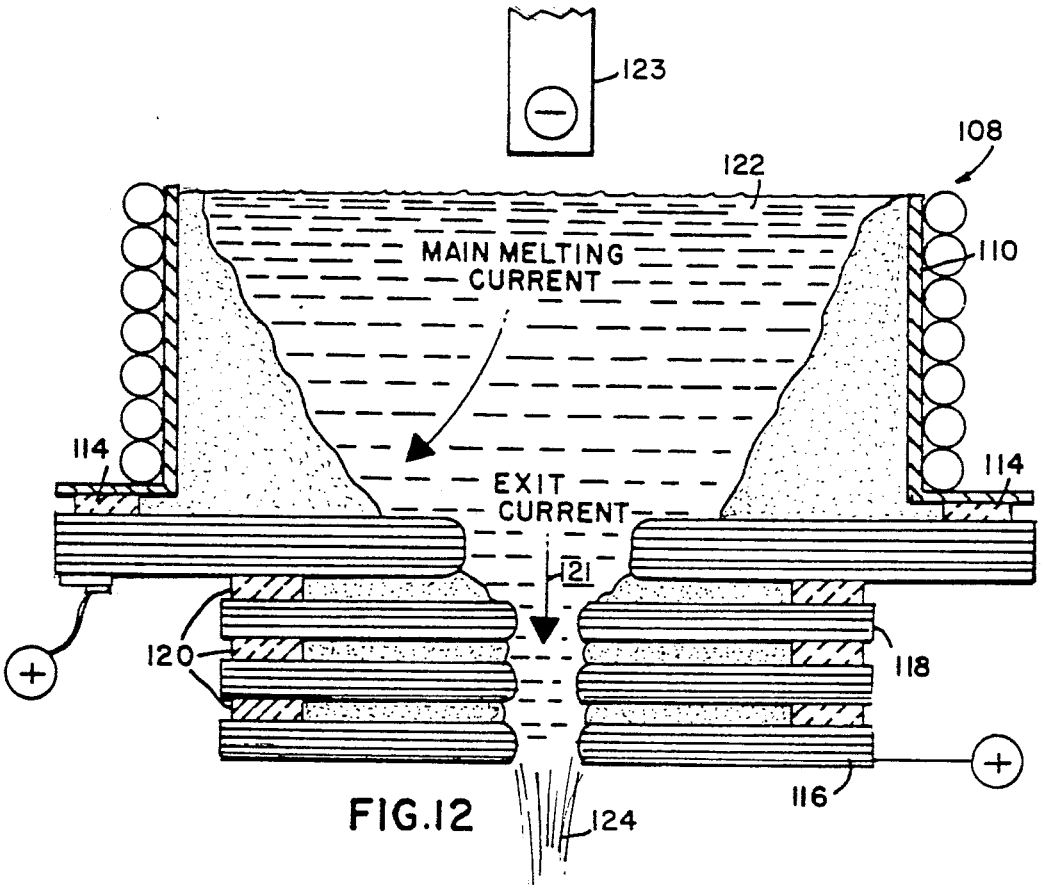
FIG. 12 is a sectional view of another embodiment of the furnace according to this invention.

The exit assembly shown in FIG. 12 was constructed on the base of a furnace similar to the one shown in FIG. 9, except that the furnace was 10 cm in diameter and 10 cm high. The furnace was constructed of water-cooled copper segments 110, spaced from the water-cooled copper base 112 by insulating spacers 114 made from phenolic plastic. The segmented exit spout 116 was constructed from water-cooled copper segments 118 spaced from each other by insulating spacers 120 made from acetal plastic. The central hole 121 in the assembly was about 5 mm in diameter.

Before charging the furnace, a piece of graphite string (not shown) was passed through the exit hole 124 and terminated on a block of graphite (not shown) held up against the bottom water cooled segment 118. The furnace was filed with crushed pieces of ceramic of composition $Al_2O_3$—40 wt % $ZrO_2$ to about $\frac{2}{3}$ of its depth. One power supply was connected between the cathode of a standard 1000A melting torch 123 (Plasma Materials Model ATA 1000) and the water-cooled plate anode at the bottom of the furnace and another between the cathode and the lowest water-cooled spacer.

An arc was struck between the plasma torch and the furnace. The current to the water-cooled plate was set to be about 100A and the current to the lower water-cooled base 112 about 40A. The charge in the furnace was then allowed to melt for about 10 minutes to form a liquid pool 122. In about the first 30 seconds of this period, it is believed that the graphite string burnt away completely, but it lasted long enough to melt the ceramic in its vicinity and so establish a conducting path of liquid ceramic to the bottom spacer. When the material in the crucible had melted out so that liquid at the top was within about 25 mm of the walls, the graphite stopper at the base of the furnace was removed suddenly and the furnace drained out through the hole 124.

What is claimed is:

1. An electric furnace for use in melting materials comprising a container having at least one sidewall having a top and bottom attached to a base member at its bottom so as to define a container cavity, said at least one sidewall containing a means being constructed from at least one electrically conductive segment and at least one electrically non-conductive segment for preventing conduction of electric current from the top of the sidewall to the bottom of the sidewall so that in operation, current flows from a plasma torch having a defined polarity disposed above the materials to be melted through the cavity and materials contained therein to portion of the container having a polarity opposite to that of the plasma torch.

2. The electric furnace of claim 1, wherein said means for preventing the conduction of electric current comprises at least one electrically non-conductive segment disposed horizontally in the at least one sidewall.

3. The electric furnace of claim 2, wherein the sidewall is composed of at least two electrically conducting segments and at least two non-conducting segments, alternately disposed one on top of the other, with a non-conducting segment being disposed between the base and an electrically conducting segment.

4. The electric furnace of claim 3, wherein the base is an anode and the plasma torch is a cathode.

5. The electric furnace of claim 1, wherein the container additionally comprises a spout disposed in the base for permitting melted material to be removed from the container, said spout having sidewalls composed of at least one non-conducting segment and at least one electrically isolated segment.

6. The electric furnace of claim 5, wherein said spout has a removable plug at one end.

7. The electric furnace of claim 1, wherein the container is generally cylindrical.

8. The electric furnace of claim 1 wherein the furnace comprises four side walls and is generally rectangular and wherein a spout is positioned at one side of the container.

9. An electric furnace for melting material comprising a substantially rectangular container having four sidewalls and a base defining a cavity for housing the material, and a means being constructed from at least one electrically conductive segment and at least one electrically non-conductive segment for preventing the conduction of electric current between each of the side walls and a plasma torch disposed above the material to be melted.

10. The electric furnace of claim 9, wherein the means for preventing the conduction of electric current comprises electrically non-conducting segments disposed between each of the sidewalls and the base.

11. The electric furnace of claim 9, wherein one of the sidewalls is front face of the container and the opposite sidewall is a rear face of the container, said front face having a spout for removing melted material from the container.

12. The electric furnace of claim 11, wherein the rear face is an anode and the plasma torch is a cathode, so that in operation current flows from the torch through the cavity and material contained therein to the rear face.

13. The electric furnace of claim 12, wherein the plasma torch is positioned near the front face.

14. A pour spout for use in an electric furnace used to melt materials, said spout being positioned in the furnace so as to permit material in the furnace to be removed, said spout being constructed from at least one electrically conductive segment and at least one electrically non-conductive segment, said spout being electrically connected to said furnace, by a connection which has an electrical resistance.

15. The pour spout of claim 14, wherein at least one electrically conductive segment and at least one electrically non-conductive segments are horizontally disposed.

16. The pour spout of claim 14, wherein at least one plug is at one end.

17. The pour spout of claim 14, wherein the spout has a current of at least 1 milliampere flowing through at least a portion thereof while there is melted material in the spout and no flow of material therethrough.

18. The pour spout of claim 14, wherein the resistance of the spout's electrical connection to the furnace exceeds 10/I ohms, wherein I is the current flowing through the furnace.

19. An electrode furnace for use in melting materials comprising a container with an open top, said container comprising at least two vertically disposed electrically conductive segments separated by a vertically disposed non-conductive segment which prevents conduction of electricity between the electrically conductive segments, and a plasma torch disposed above the open top of the container, said plasma torch having an electrode of one polarity and said container having a portion thereof of the opposite polarity so that in operation current flows form the plasma torch through the cavity and materials contained therein to the portion of the container of opposite polarity from the plasma torch.

20. The electric furnace of claim 9, wherein at least one of sidewalls has an opening therein to allow melted material to be discharged from the furnace and a means for discharging a gas beneath the opening in a jet directed away from the sidewalls.

* * * * *